US006805580B2

(12) United States Patent
Piedmont

(10) Patent No.: US 6,805,580 B2
(45) Date of Patent: Oct. 19, 2004

(54) ELECTRICAL OUTLET SAFETY COVER

(76) Inventor: Gregory H. Piedmont, 1035 S. Johnson Ave., El Cajon, CA (US) 92020

( * ) Notice: Subject to any disclaimer, the term of this patent is extended or adjusted under 35 U.S.C. 154(b) by 3 days.

(21) Appl. No.: 10/404,946

(22) Filed: Mar. 31, 2003

(65) Prior Publication Data

US 2003/0220003 A1 Nov. 27, 2003

Related U.S. Application Data

(60) Provisional application No. 60/382,698, filed on May 21, 2002.

(51) Int. Cl.[7] ..... H01R 29/00
(52) U.S. Cl. ..... 439/516; 174/66
(58) Field of Search ..... 439/516, 144; 174/66, 67

(56) References Cited

U.S. PATENT DOCUMENTS 2,878,456 A * 3/1959 Cormier ..... 439/142
4,250,349 A * 2/1981 Bennett ..... 174/67
6,198,046 B1 * 3/2001 Moodie ..... 174/67
6,309,239 B1 * 10/2001 Johnston ..... 439/373

* cited by examiner

*Primary Examiner*—Phuong Dinh
(74) *Attorney, Agent, or Firm*—Henri J.A. Charmasson; John D. Buchaca

(57) ABSTRACT

A safety cover installed over an electrical wall outlet comprises two quarter-shell segments hinged about their median sections to a base. When the two segments are clamped together, they form a protective hood over the outlet. When separated, the segments fall away from the outlet to provide free access to it. A sleeve surrounding the base can be slid over the the root of the shell segments to lock them in their closed position. The mating edges of the clamped segments are indented in their center section to accommodate the electrical cord of a jack plugged into the outlet.

16 Claims, 3 Drawing Sheets

ELECTRICAL OUTLET SAFETY COVER

PRIOR APPLICATION

This is a continuation of provisional application Ser. No. 60/382,698 filed May 21, 2002.

FIELD OF THE INVENTION

This invention relates to household electrical installation devices and more particularly to safety covers for electrical outlets intended to prevent children from touching the live prongs of a plug or inserting an object into the terminals of an outlet.

BACKGROUND OF THE INVENTION

Disclosed in my earlier U.S. Pat. No. 4,981,439, which patent is incorporated in this specification by this reference, is a safety device for preventing children from touching the live prongs of a jack plugged into a household electrical outlet, or inserting an object into the terminal of the outlets. This prior art device comprise separate components including a cover that could be easily misplaced. The instant invention results from an attempt to provide a more convenient, one-piece safety device which can also stabilize the position of a jack or plug connected to the outlet.

SUMMARY OF THE INVENTION

The principal and secondary objects of this invention are to provide a multi-function safety cover for electrical wall outlets which in an open position provides easy access to the outlet, and, in a closed position prevents access to the outlet when not in use, and stabilizes the position of a plug connected to the outlet by, among others, supporting the cord and preventing it from pulling down the plug.

These and other valuable objects are achieved by a safety cover including a base extending from a cover plate which can be substituted for the standard cover plate of the outlet, a pair of quarter-shell segments that are laterally hinged to the base and can be brought together to provide a complete enclosure of the outlet. Cut-outs in the edges of the segments allow for passage of the cord of the jack plugged into the outlet, a sleeve surrounding the base can be translated axially to lock the shell segments around the jack and cord.

DESCRIPTION OF THE PREFERRED EMBODIMENT OF THE INVENTION

Figure 1:
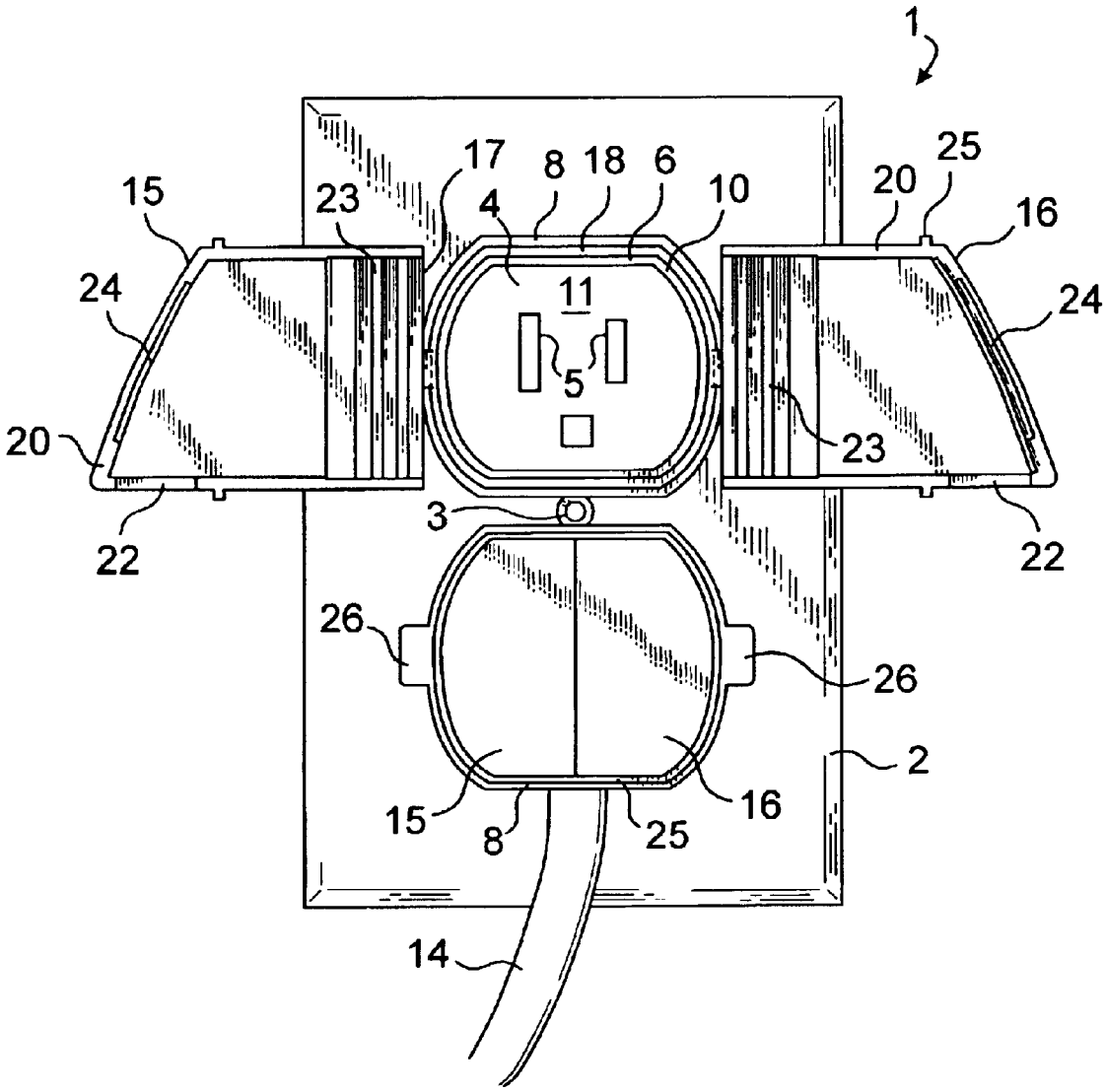
FIG. 1 is a front elevational view of the safety cover assembly showing the upper part in the open position and the lower part in the closed position.
Figure 2:
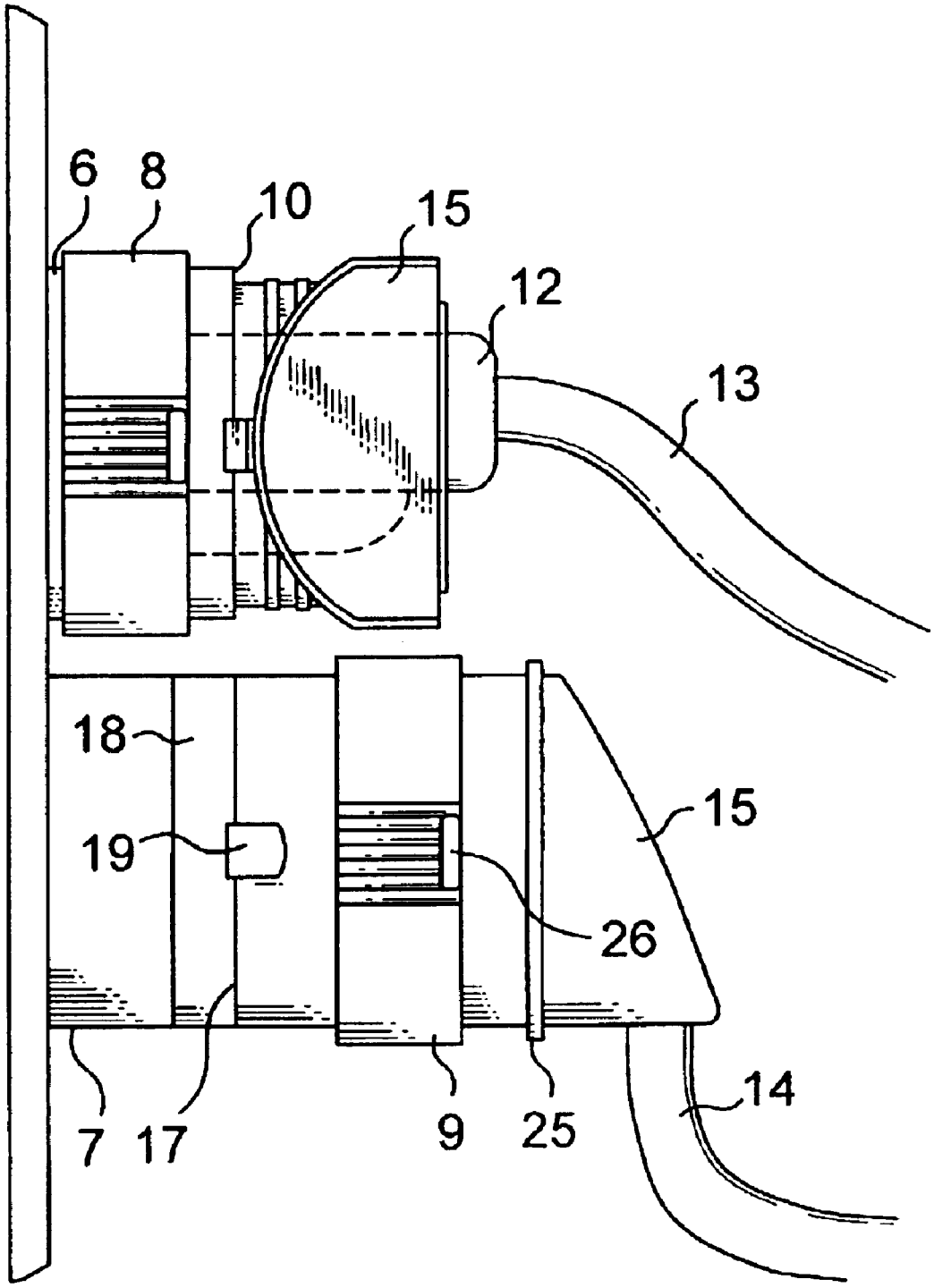
FIG. 2 is a side elevational view thereof.
Figure 3:
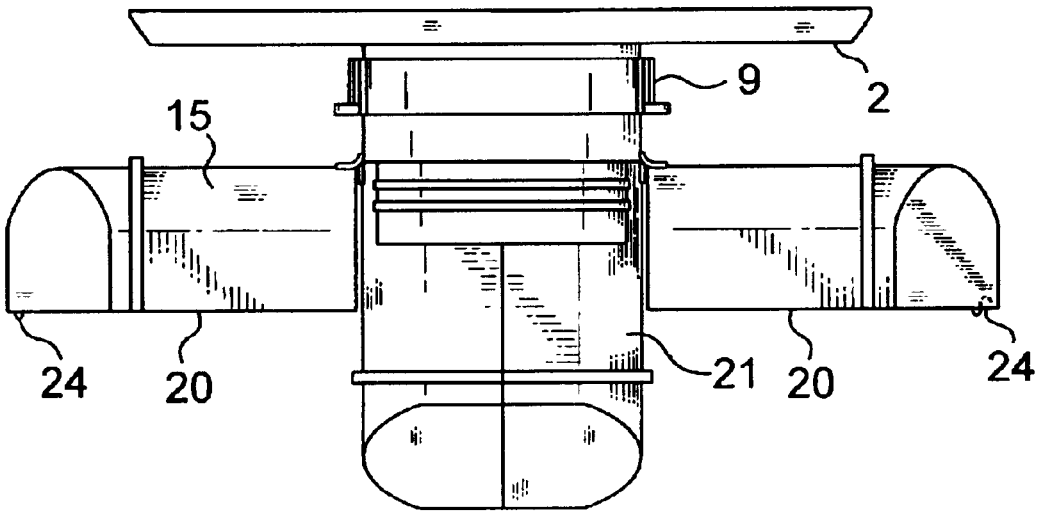
FIG. 3 is a top plan view thererof.

Referring now to the drawing, there is shown a safety cover 1 suitable for mounting in lieu of a standard cover plate over a conventional, household, dual electrical outlet. The safety cover comprises a mounting plate 2 commensurate with the substituted cover plate of the outlet. The plate has a conventional central bore 3 to pass the screw that secures it to the outlet assembly. Above and below the central bore, are two windows 4 shaped and dimensioned to give access to the terminals 5 of the dual outlet. Each of the two windows are framed by a tubular flange or base 6, 7 projecting outwardly and orthogonally from the surface of the plate 2.

The proximal edges of the bases are bonded to the peripheries of the window and, perferably, inegtrally molded with the plate.

Concentrically and slidingly surrounding the bases, is an axially slidable tubular sleeve 8, 9 translatable outwardly beyond the distal edge 10 of the base. The flange or base 6, 7 are preferably molded integrally with the plate.

The base defines a short channel 11 into which a jack or plug 12 can be inserted to contact the socket or prong terminals of the outlet with electrical cord 13, 14 projecting outwardly beyond the base.

Associated with each flange or base 6, 7 are a pair of substantially symmetrical quarter-shell segments 15, 16. Each segment has a first edge 17 which is hingedly connected about a marginal section 18 at the outer, that is distal edge of the base by a creased strip of flexible material 19 or other suitable hinging structure. The segments are shaped and dimensioned so that when they are brought together over the base and sleeve, they extend over and distally apart from the channel and, completely prevent access to the outlet.

Each segment has a second edge 20 which lies in a plane substantially perpendicular to the first edge 17. Each second edge runs contiguously and mates with the second edge of the mating segment in the above-described closed position.

The two segments 15, 16 project outwardly by about 4 centimeters to form, in their closed position, a chamber 21 which completely encloses a jack or plug inserted into the terminals. A cut-out 22 in the lower portion of each second edge 20 provides clearance for an electrical cord. The proximal portion of each shell segment is reinforced by ribbings 23 running parallelly to the first edge 17. The frontal section of the second edges 20 are shaped into a tongue-and-groove mating configuration 24. The two shell segments are kept in their closed position by the ring or sleeve 9 that surrounds the base and can be axially slid over the segments. The forward translation of the sleeve is limited by a flange 25 formed on the periphery of the shell segments. A pair of ears 26 projecting sideways from the sleeve allow for easy manual translation.

While the preferred embodiment of the invention has been described, modifications can be made and other embodiments may be devised without departing from the spirit of the invention.

What is claimed is:

1. A safety cover, for an electrical outlet having a plurality of socket or prong terminals, which comprises:

a tubular base having a central channel shaped and dimensioned to allow access to said terminal;

means for mounting said base over said outlet;

a first shell segment hingedly connected to an distal edge portion of said base and being alternately movable to a close position over said opening and to an open position away from said channel;

means for locking said segment in said close position; and a second shell segment substantially symmetrical to said first segment, each of said segments being shaped and dimensioned to extended over and distally apart from said channel; and, wherein said means for locking comprises an axially slidable sleeve surrounding said base and being translatable over a peripheral portion of said shell segment.

2. The safety cover of claim 1, wherein said segments are shaped to form a chamber in said closed position, said chamber being dimensioned to completely enclose a plug inserted into said terminals.

3. The safety cover of claim 2, wherein said segments have a cut-out dimensioned to allow passage of an electrical cord.

4. The safety cover of claim 2, wherein said segments have mating tongue-and-groove interfacing edges.

5. The safety cover of claim 3, which further comprises a mounting plate having at least one window peripherally connected to a proximal edge portion of said base.

6. A safety cover, for an electrical outlet having a plurality of socket or prong terminals, which comprises:

a tubular base having a central channel shaped and dimensioned to allow access to said terminal;

means for mounting said base over said outlet:

a first shell segment hingedly connected to an distal edge portion of said base and being alternately movable to a close position over said channel and to an open position away from said channel;

means for locking said segment in said close position;

a second shell segment substantially symmetrical to said first segment each of said segments being shaped and dimensioned to extend over and distally apart from said channel;

wherein said segments are shaped to form a chamber in said closed position, said chamber being dimensioned to completely enclose a plug inserted into said terminal, wherein said segments have a cut-out dimensioned to allow passage of an electrical cord; and, a mounting plate having at least one window peripherally connected to a proximal edge portion of said base;

wherein said means for locking comprises an axially slidable sleeve surrounding said base and being translatable over a peripheral portion of said shell segment.

7. The safety cover of claim 6, wherein said segments are shaped to form a chamber in said closed position, said chamber being dimensioned to completely enclose a plug inserted into said terminals.

8. The safety cover of claim 1, which further comprises a mounting plate having at least one window peripherally connected to a proximal edge portion of said base.

9. A safety cover, for an electrical outlet having a plurality of socket or prong terminals, which comprises:

a tubular base having a central channel shaped and dimensioned to allow access to said terminal;

means for mounting said base over said outlet;

a first shell segment hingedly connected to an distal edge portion of said base and being alternately movable to a close position over said opening and to an open position away from said opening; and an axially slidable sleeve surrounding said base and being translatable over a peripheral portion of said first shell segment.

10. The safety cover of claim 9, which further compresses a second shell segment mounting plate having at least one window peripherally connected to a proximal edge portion of said base.

11. The safety cover of claim 9, which further comprises a second shell segment substantially symmetrical to said first segment, each of said segments being shaped and dimensioned to extend over and distally apart from said channel.

12. The safety cover of claim 11, wherein said segments ate shaped to form a chamber in said closed position, said chamber being dimensioned to completely enclose a plug inserted into said terminals.

13. The safety cover of claim 12, wherein said segments have a cut-out dimensioned to allow passage of an electrical cord.

14. The safety cover of claim 12, wherein said segments have mating tongue-and-groove interfacing edges.

15. A method for safely covering an electrical outlet having a plurality of socket or prong terminals, said method comprises:

mounting a tubular base over said outlet;

hingedly connecting a first shell segment to a distal edge portion of said base;

moving said first shell segment into a first closed position over said channel;

axially sliding a sleeve surrounding said base over a peripheral portion of said first shell segment, thereby locking said first shell segment in said first closed position.

16. The method of claim 15, which further comprises moving a second shell segment substantially symmetrical to said first segment into a second closed position over said channel, and wherein said axially sliding locks both of said segments into said first and second closed positions.

* * * * *